United States Patent [19]
Scribner
[11] 4,207,999
[45] Jun. 17, 1980

[54] STOCK FEEDER FOR PUNCH PRESSES AND THE LIKE

[76] Inventor: Albert W. Scribner, 6 Country Club Rd., Darien, Conn. 06820

[21] Appl. No.: 928,546

[22] Filed: Jul. 27, 1978

[51] Int. Cl.[2] ..... B65H 17/36; B65H 17/44
[52] U.S. Cl. ..... 226/150; 226/162
[58] Field of Search ..... 226/162, 165, 166, 147, 226/149, 150, 158

[56] References Cited

U.S. PATENT DOCUMENTS

| | | | |
|---|---|---|---|
| 2,406,508 | 8/1946 | Papsdorf | 226/162 X |
| 2,467,740 | 4/1949 | Haller | 226/150 |
| 2,803,335 | 8/1957 | Powers | 226/166 |
| 3,038,645 | 6/1962 | Nordlof | 226/149 |
| 3,157,334 | 11/1964 | Bunnell et al. | 226/162 X |
| 3,429,493 | 2/1969 | Lehmann | 226/150 |
| 3,462,056 | 8/1969 | Scribner | 226/150 |
| 3,512,438 | 5/1970 | Burdge | 226/149 X |

*Primary Examiner*—Stanley N. Gilreath

[57] ABSTRACT

An improved control circuit for the pneumatically operated punch press feeder illustrated in U.S. Pat. No. 3,038,645; the use of which circuit permits a simplification of the construction of the feeder by enabling the stock clamping as well as the stock gripping motors of feeder to be single acting. This improved circuit and the resultant simplification of structure will allow benefits of the sequencing action of the dual valve system to be retained while reducing the cost of manufacture and maintenance of such a feeder.

6 Claims, 1 Drawing Figure

STOCK FEEDER FOR PUNCH PRESSES AND THE LIKE

BACKGROUND OF THE INVENTION

The feeder disclosed in said U.S. Pat. No. 3,038,645 utilizes single acting fluid gripper motors 87 and double acting fluid clamping motors 77; the latter, as may be seen from FIGS. 2 and 7 of said patent, being not only more complex structurally but also requiring more air service lines thereto than that for the former. This being the case the use of such double acting clamping motors represents an added initial and maintenance cost over that associated with single acting motors as used in the feeder arrangement disclosed in said Patent.

SUMMARY OF THE INVENTION

This invention relates to, and has a primary object of providing, an improvement in the control circuitry for a pneumatic punch feeder of the type disclosed in U.S. Pat. No. 3,038,645 wherein the use of such an improved circuit will allow single acting instead of double acting fluid motors to be used in the said feeder for clamping the stock.

Other objects of the invention will become apparent as the disclosure progresses.

DETAILED DESCRIPTION OF THE INVENTION

Figure 1:
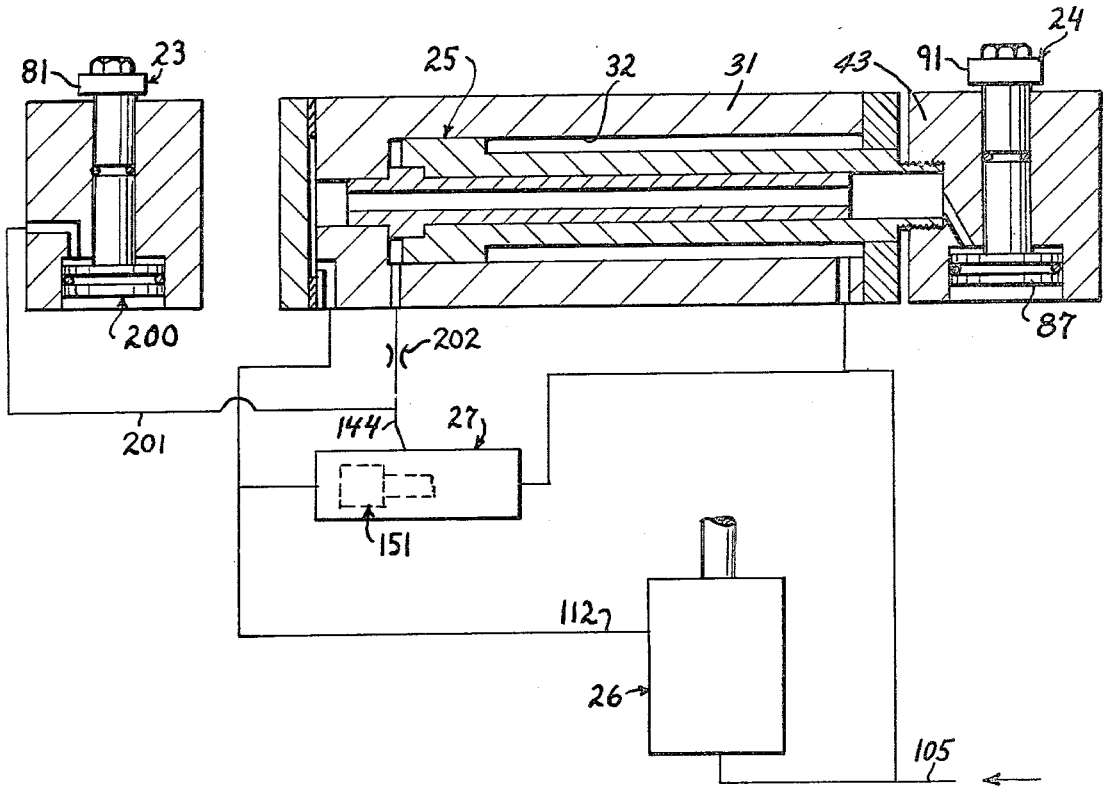
FIG. 1 is a circuit diagram illustrating the control system and the associated fluid motors for the present feeder.

Referring first to the disclosure in said Patent, which disclosure and the present commercially available feeder corresponding thereto as marketed by the Rapid Air Corp. of Madison, S.D. are incorporated herein by reference, the control circuit therein includes two valves, namely a control valve 26 and a main or pilot three way valve 27; the output line 144 of the main valve being coupled to the head end of the main fluid motor 25 while the output line 112 from the control valve 26 is coupled to the three fluid motor means, namely the stock clamping motors 77, the stock gripping motors 87 and the fluid motor or actuator 151 for operating the main valve 27. In this control arrangement fluid pressure is supplied simultaneously to both the clamping and gripping motors and then exhausted simultaneously therefrom and thus the gripping motors are made single acting and the clamping motors are made double acting so that only one or the other of the clamping means 23 or gripping means 24 are operative during each successive stroke of the feed slide 43.

In that the construction of and the controls for double acting fluid motors are more complex than that for single acting motors the present invention contemplates a modification of the control circuit of said patent so as to permit benefits of the sequencing action of the dual valve type control system disclosed in said patent to be retained and at the same time to enable the stock clamping motors to be made single acting; thus reducing the initial and maintenance costs of the feeder.

FIG. 1 herein illustrates the modification of the structure and controls disclosed in said patent; the parts indicated by the reference numerals used herein, unless otherwise indicated, corresponding to the similarly numbered parts in said patent. Here the stock clamping fluid motors 200 are made single acting in a manner similar to motors 87, and the output line from the main three way valve 27 is coupled not only to the head end of the main cylinder 32 as in said patent but also through line 201 to the said single acting stock clamping fluid motors 200. The output line 112 from the control valve 26 is coupled to the fluid motor 151 that is adapted to operate the said main valve 27 and to the single acting stock gripping motors 87. A suitable restriction 202 is placed as shown in the line to the main fluid motor so that the latter will operate just after operation of the stock clamp motors 200. The main valve 27 of the said Patent controls only the main fluid motor 25 whereas in the present arrangement the main valve 27 controls both the main fluid motor 25 and the stock clamping motors 200. Likewise the control valve 26 of said patent controls motors 77, 87 and 151 whereas in the present control arrangement valve 26 controls only motors 87 and 151. It will be understood that any suitable air passage lines are formed in the main body 31 so as to constitute the circuit shown in FIG. 1.

The items indicated in the drawing by reference numerals 81, 91, 105 and 144 respectively correspond to items similarly numbered in said patent.

In operation when the control valve 26 is operated by the downward movement of the press ram the gripper motors 87 and the main valve motor 151 will be exhausted first, and when the main valve is thus shifted the stock clamping motors 200 will be immediately pressurized and thereafter (due to the impedance 202 in the line to the head end of main fluid motor 25) said main fluid motor will be pressurized so as to initiate an index stroke of the feed slide 43; the stock gripping means 24 being in its stock release position and the clamping means 23 being in its stock clamping position during this index stroke of the feed slide. When the control valve 26 is restored to its normal position in response to the upward movement of the press ram the stock gripping motors 87 and the main valve motor 151 will be pressurized first and when the main valve is so shifted the single acting stock clamp motors 200 will be exhausted and immediately thereafter the head end of the main cylinder 32 will also be exhausted so as to initiate a feed stroke of said feed slide; the gripping means 24 being in its stock gripping position and the clamping means 23 being in its stock release position during this feed stroke.

As will be seen then the above described modification of the control circuit will involve little or no added cost to the control means but will allow the clamping motors 200 to be single acting rather than double acting as is the case in said patent. This will reduce the number of parts, control lines, etc. and will thus reduce the cost of manufacture and maintenance of the feeder while still retaining benefits of the sequencing action of the dual valve control system described in said Patent.

I claim:

1. A pneumatically operated stock feeder for intermittently advancing stock into the work station of a punch press or the like: comprising a frame;

a feed slide carried by said frame for reciprocation in feed and index directions;

a first fluid motor means for actuating said feed slide;

stock gripping means carried by said feed slide and being movable between stock gripping and release positions;

a second fluid motor means for actuating said stock gripping means;

a stock clamping means carried by said frame and being movable between stock clamping and release positions;

a third fluid motor means for actuating said stock clamping means;

a main valve means adapted to be shifted between at least two operative conditions and having an output that is coupled to both said third and first fluid motor means for causing actuation of said stock clamping means and said feed slide respectively;

a fourth fluid motor means for shifting said main valve means between said operative conditions; and a control valve means having an output that is coupled to said second and fourth fluid motor means for causing actuation of said stock gripping means and said main valve means respectively.

2. Apparatus as defined by claim 1 wherein said third fluid motor means includes a single acting fluid motor.

3. Apparatus as defined by claim 1 or 2 wherein said first fluid motor means includes a cylinder having a head end, and wherein said output of said main valve is coupled to said head end of said cylinder of said first fluid motor means.

4. Apparatus as defined by claim 1 wherein said main valve means comprises a three way valve.

5. Apparatus as defined by claim 2 or 4 wherein said second fluid motor means includes a single acting fluid motor.

6. Apparatus as defined by claim 1 wherein said first fluid motor means comprises a double acting fluid motor, wherein said second and third fluid motor means each comprises a single fluid motor, and wherein said main valve means and said control valve means comprise separate three way valves.

* * * * *